US006942164B2

(12) United States Patent
Walker

(10) Patent No.: US 6,942,164 B2
(45) Date of Patent: Sep. 13, 2005

(54) ROTATING STREAM SPRINKLER WITH TURBINE SPEED GOVERNOR

(75) Inventor: Samuel C. Walker, Upland, CA (US)

(73) Assignee: Rain Bird Corporation, Glendora, CA (US)

( * ) Notice: Subject to any disclaimer, the term of this patent is extended or adjusted under 35 U.S.C. 154(b) by 37 days.

(21) Appl. No.: 10/377,208

(22) Filed: Feb. 28, 2003

(65) Prior Publication Data

US 2004/0195360 A1 Oct. 7, 2004

(51) Int. Cl.[7] ..... B05B 15/10; B05B 15/06; B05B 3/00; B05B 3/04; A01G 25/06

(52) U.S. Cl. ..... 239/204; 239/201; 239/203; 239/206; 239/237; 239/240; 239/580

(58) Field of Search ..... 239/201, 203, 239/204, 206, 237, 240, 580, 225.1

(56) References Cited

U.S. PATENT DOCUMENTS 3,854,664 A * 12/1974 Hunter ..... 239/206

4,131,234 A * 12/1978 Pescetto ..... 239/457

* cited by examiner

*Primary Examiner*—David A. Scherbel
*Assistant Examiner*—Darren Gorman
(74) *Attorney, Agent, or Firm*—Fitch, Even, Tabin & Flannery

(57) ABSTRACT

A rotating stream sprinkler of the type having a rotatable deflector with spiral vanes engaged by one or more water jets for imparting a rotary drive torque to the deflector, which converts the jets into a plurality of relatively small outwardly projected water streams swept over the surrounding terrain to irrigate adjacent vegetation. The sprinkler includes a speed governor having a turbine driven orbiter with first and second gears meshed respectively with a stator gear and a driven gear having different numbers of gear teeth, wherein the driven gear is carried by the deflector for rotation therewith. The turbine rotatably drives the orbiter on an eccentric axis, to react against the stator gear and thereby rotatably drive the driven gear and deflector with a substantial speed reduction. The speed governor thus regulates deflector speed for slowly sweeping the projected water streams over the adjacent landscape.

52 Claims, 7 Drawing Sheets

FIG. 6
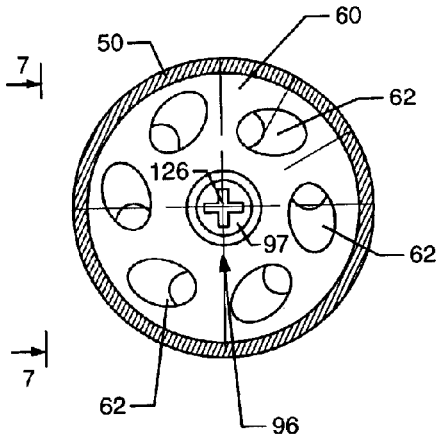
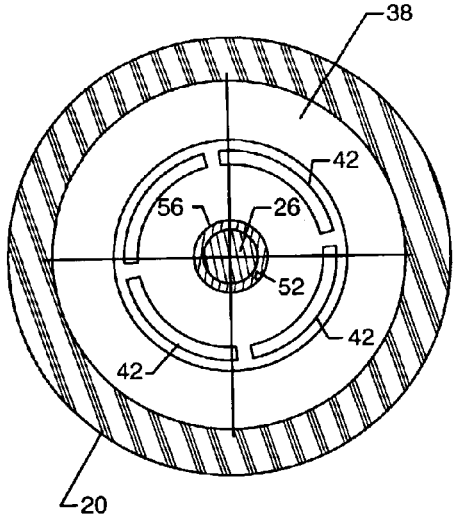
FIG. 8
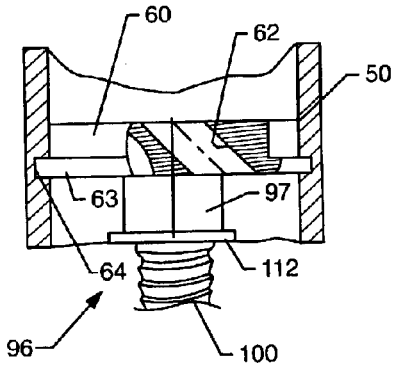
FIG. 7

ROTATING STREAM SPRINKLER WITH TURBINE SPEED GOVERNOR

BACKGROUND OF THE INVENTION

This invention relates generally to improvements in irrigation sprinklers of the so-called micro-stream type having a rotatably driven vaned deflector for sweeping a plurality of relatively small water streams over a surrounding terrain area to irrigate adjacent vegetation. More specifically, this invention relates to an improved rotating stream sprinkler having a turbine driven gear drive arrangement for regulating the rotational speed of the vaned deflector to a controlled and relatively slow rate for sweeping and distributing the water streams relatively slowly over the adjacent landscape.

Rotating stream sprinklers, sometimes referred to as micro-stream sprinklers, are well known in the art of the type for producing a plurality of relatively small outwardly projected water streams swept over surrounding terrain for landscape irrigation. In one common form, one or more jets of water are directed upwardly against a rotatable vaned deflector which has a vaned lower surface defining an array of relatively small flow channels extending upwardly and turning radially outwardly with a spiral component of direction. The water jet or jets impinge upon this array of vanes to fill the curved flow channels and to impart a rotary drive torque for rotatably driving the deflector. At the same time, the water is guided by the curved flow channels for projection generally radially outwardly from the sprinkler in the form of a plurality of relatively small water streams to irrigate adjacent vegetation. As the deflector is rotatably driven, these small water streams are swept over the surrounding terrain area, with a range of throw depending in part on the channel configuration. Such rotating stream sprinklers have been designed for irrigating a surrounding terrain area of predetermined pattern, such as a full circle, half-circle, or quarter-circle pattern. For examples of such rotating stream sprinklers, see U.S. Pat. Nos. 4,660,766; 4,796,811; 4,815,662; 4,971,250; 4,986,474; Re. 33,823; U.S. Pat. Nos. 5,288,022; 5,058,806; 5,845,849; and 6,244,521.

In rotating stream sprinklers of this general type, it is desirable to control or regulate the rotational speed of the vaned deflector and thereby also regulate the speed at which the small water streams are swept over the surrounding terrain. In this regard, in the absence of speed control or brake means, the vaned deflector can be rotatably driven at an excessive speed up to and exceeding 1,000 rpm, resulting in rapid sprinkler wear and distorted water stream delivery patterns with reduced projected range. A relatively slow deflector rotational speed on the order of about 4–20 rpm is desired to achieve extended sprinkler service life while producing substantially uniform and consistent water stream delivery patterns. Toward this end, a variety of fluid brake devices have been developed wherein a rotor element carried by the vaned deflector is rotatably driven within a closed chamber containing a viscous fluid. In such designs, the viscous fluid applies a substantial drag to rotor element rotation which significantly reduces the rotational speed of the vaned deflector during sprinkler operation.

While such fluid brake devices are effective to prevent deflector rotation at excessive speeds, the actual rotational speed of the deflector inherently and significantly varies as a function of changes in water pressure and flow rate through the sprinkler. Since these parameters can vary during any given period or cycle of sprinkler operation, corresponding changes or fluctuations in the water stream delivery patterns can and do occur to result in inconsistent and sometimes inadequate irrigation of adjacent vegetation. In addition, such fluid brake concepts require the use and effective sealed containment of a viscous fluid such as a silicon-based oil or the like, which undesirably increases the overall complexity and cost of the irrigation sprinkler.

There exists, therefore, a need for further improvements in and to rotating stream sprinklers of the vaned deflector type for sweeping a plurality of relatively small water streams over a surrounding terrain area, particularly with respect to rotatably driving the vaned deflector at a controlled and relatively slow rotational speed to achieve improved and consistent water distribution with a substantially maximized the range of the outwardly projected water streams. The present invention fulfills these needs and provides further related advantages.

SUMMARY OF THE INVENTION

In accordance with the invention, a rotating stream sprinkler is provided of the type having a spiral vaned deflector for rotatably sweeping and distributing a plurality of relatively small outwardly projected water streams swept over a surrounding terrain area to irrigate adjacent vegetation. The sprinkler includes a turbine driven speed governor having meshed reduction gear components for regulating and limiting the speed of the deflector to a relatively slow rate of rotation which is approximately constant throughout a range of normal water supply pressures and flow rates.

The rotating stream sprinkler comprises the vaned deflector having an underside surface defined by an array of spiral vanes with generally vertically oriented upstream ends which spiral or curve and merge smoothly with generally radially outwardly extending and relatively straight downstream ends having a selected angle of inclination. These spiral vanes cooperatively define a corresponding array of intervening, relatively small flow channels of corresponding configuration. One or more upwardly directed water jets impinges upon the spiral vanes and are subdivided thereby into the plurality of relatively small water streams flowing through said channels. These water streams impart a rotational drive torque to the deflector and are then projected generally radially outwardly therefrom. As the deflector is rotated, these relatively small water streams are swept over the surrounding terrain area.

The turbine driven speed governor, in the preferred form, comprises a turbine rotatably driven at a relatively high rate of speed by water under pressure supplied to the sprinkler. The turbine rotatably drives an orbiter having a first or reaction gear meshed with a stator gear having a different number of gear teeth, and a second or drive gear meshed with a driven gear rotatably carried with the deflector and also having a different number of gear teeth. The orbiter is driven on an eccentric axis and reacts against the stator gear for rotatably driving the driven gear and deflector with a substantial speed reduction, thereby sweeping and distributing the projected water streams over the adjacent landscape at a regulated and relatively slow rate of speed with a substantially maximum projected range.

The rotating stream sprinkler further includes a flow rate adjustment assembly for selectively varying the rate of water inflow to the sprinkler to correspondingly permit selection of the projected range of the irrigation water streams. This flow rate adjustment assembly includes a rotatable adjustment screw carrying an axially translatable nut for bearing against a compressible restrictor element. Rotation of the adjustment screw selectively positions the nut in variable bearing engagement against the restrictor element for varying the cross sectional area of one or more inflow ports for water flow to the turbine and vaned deflector. The deflector can be axially shifted or depressed to engage a tool tip on a turbine shaft with the adjustment nut, and also to disengage the stator gear from a stator key to uncouple the deflector from the reduction gear components. In this depressed position, the deflector can be rotated for rotating the adjustment screw.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings:

FIG. 6 is a horizontal sectional view taken generally on the line 6—6 of FIG. 3;

FIG. 7 is an enlarged fragmented side elevation view taken generally on the line 7—7 of FIG. 6, with portions broken away to illustrate construction details of an internally mounted swirl plate;

FIG. 8 is a horizontal sectional view taken generally on the line 8—8 of FIG. 3;

DETAILED DESCRIPTION OF THE PREFERRED EMBODIMENT

Figure 1:
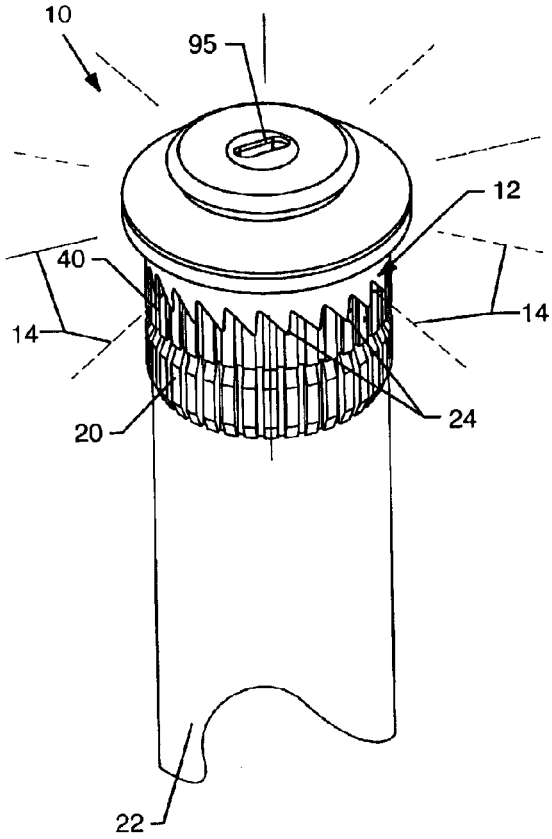
FIG. 1 is a fragmented perspective view illustrating a rotating stream sprinkler of the present invention installed onto the upper end of a riser, wherein the rotating stream sprinkler includes a rotatably driven vaned deflector for sweeping relatively small water streams over a surrounding terrain area.

As shown in the exemplary drawings, a rotating stream sprinkler referred to generally in FIGS. 1–4 by the reference numeral 10 includes a spiral vaned deflector 12 for producing and distributing a plurality of relatively small water streams 14 (FIG. 1) projected radially outwardly therefrom to irrigate a surrounding terrain area. A speed control governor including a water-driven turbine 16 (FIGS. 3–4) and a reduction gear train 18 (FIGS. 3–4) regulates the rotational speed of the deflector 12 at a controlled and relatively slow rate for sweeping the projected water streams 14 relatively slowly over the adjacent landscape with a substantially consistent water distribution pattern and a substantially maximized projected stream range.

Figure 2:
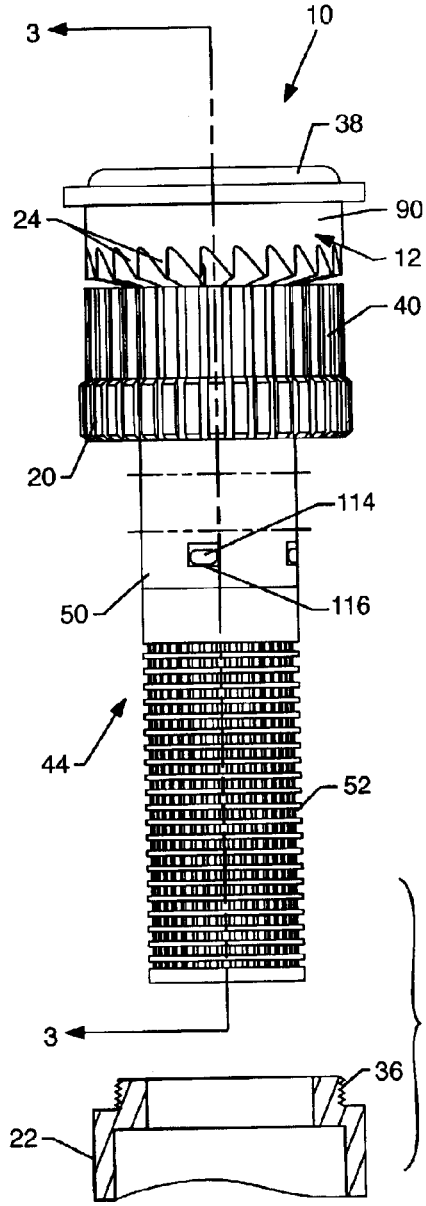
FIG. 2 is a side elevation view of the rotating stream sprinkler viewed in FIG. 1, shown in exploded relation with the riser depicted in partial section.

The rotating stream sprinkler 10 of the present invention generally comprises a compact sprinkler nozzle unit or head having a base 20 adapted for convenient thread-on mounting or the like onto the upper end of a stationary or pop-up tubular riser 22(FIGS. 1–2). In general terms, the deflector 12 is rotatably supported on the base 20 and includes an underside surface defining an array of spiral vanes 24 (FIGS. 1–5) positioned for impingement engagement by one or more upwardly directed water jets. These water jets impart a rotary drive torque to the deflector, and are subdivided by the vanes 24 for radially outward projection of the plurality of relatively small water streams 14 (FIG.1) with a selected angle of inclination to irrigate surrounding vegetation. The turbine driven speed governor includes the turbine 16 which is rotatably driven at a relatively high rate of speed by water under pressure supplied to the sprinkler 10 for normal operation. The turbine 16 is connected by a drive shaft 26 (FIGS. 3–4) to eccentrically drive an orbiter 28 having gear components meshed respectively with a stator gear 30, and with a driven gear 32 carried for rotation with the deflector 12. These meshed gear components provide a substantial speed ratio reduction for limiting the rotation speed of the deflector 12 to a controlled and relatively slow rotation speed on the order of about 4–20 rpm, and which is substantially constant throughout a range of normal water supply pressures and flow rates. Accordingly, the improved sprinkler 10 beneficially provides a consistent and uniform pattern of water distribution during each operating cycle, with a substantially maximum water stream range or trajectory.

More particularly, as shown in FIGS. 1–4 in accordance with one preferred form of the invention, the sprinkler base 20 which may be formed conveniently from a suitable lightweight molded plastic or the like to have a generally cylindrical shape with an internal female thread 34 (FIG. 3) formed within a lower region thereof for convenient and simple mounting onto an externally threaded upper end 36 (FIG. 2) of the tubular riser 22. A pattern plate 38, which may also be formed form a suitable lightweight molded plastic, is shown mounted onto an upper end of the base 20 as by snap-fit adhesive, or welded connection of an outer cylindrical wall 40 to an upper peripheral margin of the base 20. Alternately, persons skilled in the art will recognize and appreciate that the pattern plate 38 may be formed integrally with the base 20, if desired. In either configuration, the pattern plate 38 generally comprises a substantially closed wall interrupted by one or more upwardly open jet ports 42 (viewed best in FIGS. 4 and 8) formed therein in an annular pattern, with the illustrative drawings showing four elongated arcuate ports 42 each spanning an arcuate range of slightly less than 90° for substantially full-circle distribution of water from the sprinkler during operation, as will be described in more detail. It will be understood that the number and geometry of these jet ports 42 can be varied for selected part-circle water distribution, such as a quarter-circle, half-circle, or other selected part-circle irrigation pattern.

A filter unit 44 having an upwardly open and generally cup-shaped configuration is mounted at the underside of the sprinkler base 20. In one form, this filter unit 44 includes an outwardly radiating upper flange 46 having a size and shape for press-fit or snap-fit reception into the underside of the base 20, as by snap-fit connection with an inwardly radiating shoulder 48 (FIG. 3) formed thereon. A generally cylindrical side wall is suspended from this upper flange 46 an includes a substantially imperforate upper wall segment 50 joined to a perforated lower wall segment 52. In one alternative form, the filter unit 44 may be configured for slide-fit reception into the open upper end of the riser 26, with the flange 46 rested upon the riser upper end, prior to thread-on mounting of the base 20. In either configuration, the perforated lower wall segment 52 of the filter unit 44 is sufficiently spaced from an internal diameter surface of the riser 26 so that water inflow to the sprinkler 10 must pass through the perforations which obstruct passage of sizable particulate and other debris which could otherwise damage sprinkler components.

The turbine 16 is mounted at a lower end of the drive shaft 26 extending downwardly through a central aperture formed in the pattern plate 38. This drive shaft 26 is rotatably carried within a tubular bearing sleeve 56, a lower end of which extends downwardly through the pattern plate 38 as by press-fit or snap-fit reception therethrough and terminates in a lower end captured by a shaft seal 58. The turbine 16 is mounted onto the drive shaft 26 as by press-fit to snap-fit mounting thereon, to position the turbine within an upper region of the filer unit 44 generally surrounded by the imperforate upper wall segment 50 and in the path of upward water flow to the sprinkler 10, when the riser 22 is connected to a supply of water under pressure. A swirl plate 60 is also positioned within the substantially ixnperforate wall segment 50 of the filter unit 44, at an upstream location relative to the turbine 16, and includes an annular array of angularly oriented swirl ports 62 (shown best in FIGS. 6–7) for imparting a circumferential swirl flow to water inflow passing through the riser 22 to the sprinkler 10. This swirling water flow rotatably drives the turbine 16 and the associated drive shaft 26. As shown, the swirl plate 60 may include a peripheral ridge 63 (FIG. 7) for snap-fit mounting into a matingly shaped internal groove 64 formed within the imperforate wall segment 50 of the filter unit 44.

The drive shaft 26 and the associated bearing sleeve 56 project upwardly from the pattern plate 38, and through a central bore 66 (FIGS. 3 and 5) formed in the deflector 12. An annular seal 68 is nested in a shallow counterbore 70 at an upper side of the deflector 12 for rotatably supporting the deflector on the bearing sleeve 56. An upper end of the bearing sleeve 56 terminates in a stator key 72 (shown best in FIG. 4) having a non-circular shape, such as a rectangular configuration as shown in the illustrative embodiment of the invention.

The deflector 12, which also may be conveniently formed from lightweight molded plastic, incorporates the array of vanes 24 formed on an underside surface thereof. This array of vanes is disposed, as previously described, for engagement by the jet or jets of water flowing upwardly from the pattern plate 38, in accordance with the number and configuration of jet ports 42 formed in the pattern plate. These vanes 24 (shown best in FIG. 5) are shown to have a generally V-shaped cross section defining a corresponding plurality of intervening flow channels of inverted generally V-shaped cross section having upstream segments extending upwardly and then curving smoothly with a spiral component of direction to merge with relatively straight downstream segments that extend generally radially outwardly with a selected inclination angle. In operation of the sprinkler, the upwardly directed water jet or jets from the pattern plate 38 impinge upon the lower or upstream segments of these vanes 24 which subdivide the water flow into the plurality relatively small flow streams 14 for passage through the flow channels and radially outward projection from the sprinkler. Due to the spiral component of the vane shape, these water jets additionally impart a rotary drive torque to the deflector 12 to assist in rotatable driving thereof.

An upper end of the drive shaft 26 projects a short distance above the stator key 72 at the upper end of the bearing sleeve 56, and terminates in an upwardly projecting drive pin 74 disposed off-axis relative to a rotational axis of the drive shaft. This drive pin 74 is seated as by a slip-fit connection within a central port 76 formed in the orbitor 28. As viewed best in FIGS. 3, 4, 9 and 10, the orbiter 28 has a generally circular shape to include a pair of male ring gears 78 and 80 formed respectively on the axially lower and upper surfaces thereof. The drive shaft 26 rotatably drives the drive pin 74 about an eccentric axis for correspondingly rotatably driving the orbiter 28 with an eccentric orbital motion.

The first or lower ring gear 78 on the orbiter 28 comprises a reaction gear supported by the drive pin 74 in an off-axis position meshed at one side along a line of contact with the stator gear 30. In this regard, the stator gear 30 comprises a diametrically larger female ring gear formed on a disk-shaped stator member 84 carried by the upper end of the bearing sleeve 56 and including a hub recess 86 of noncircular shape for normally receiving the stator key 72 of mating configuration. Accordingly, during normal sprinkler operation, the stator key 72 on the nonrotating bearing sleeve 56 interengages with the stator member 84 by means of the hub recess 86 to lock the stator member 84 and the associated stator gear 82 thereon against rotation.

The second or upper ring gear 80 on the orbiter 28 comprises a drive gear supported by the drive pin 74 in an off-axis position meshed at one side along a line of contact with the driven gear 32 for rotatably driving and regulating the rotational speed of the deflector 12. More specifically, the driven gear 32 also comprises a comparatively larger diameter female ring gear formed on a cap plate 88 having a size and shape for mounting onto and for rotation with the deflector 12. As shown, the illustrative cap plate 88 is designed for press-fit or other suitable attachment of the female driven gear 32 into an open upper end of a cylindrical wall 90 formed on the deflector 12 and upstanding from the periphery of the spiral vane array 24. Accordingly, the cap plate 88 is connected to and rotatable with the deflector 12. In addition, the cap plate 88 cooperates with the deflector 12 including the outer cylindrical wall 90 thereof to define a substantially enclosed chamber 92 within which the above described speed reduction gear components are protectively mounted.

In the preferred form, and in accordance with one primary aspect of the invention, the reaction and drive gears 78, 80 on the orbiter 28 are coaxial and have a generally or substantially common diametric size somewhat less that the stator and driven gears 30, 32 which also are coaxial and have generally or substantially common diametric size. Accordingly, the reaction and drive gears 78, 80 mesh with their respective stator and driven gears 30, 32 along a generally common or directly overlying orbital or radial line of contact. In addition, the number of gear teeth on each of the reaction and drive gears 78, 80 is different from the number of gear teeth on the stator and driven gears 30, 32 meshed respectively therewith to achieve a substantial speed reduction ratio in the drive speed of the cap plate 88 and deflector 12 relative to the drive shaft 54. For example, in one working embodiment of the invention, the reaction gear 78 on the orbiter 28 includes 31 gear teeth for meshed engagement with the stator gear 30 which has 32 gear teeth. In turn, the drive gear 80 on the orbiter 28 includes 32 gear teeth for meshed engagement with the driven gear 32 which has 33 gear teeth. In this particular geometry, this results in a speed ratio reduction of 32 between pair of meshed gears 78, 30 and 80, 32 for a total gear train speed reduction of $32^2$, or 1,024.

During normal sprinkler operation, water under pressure is supplied via the riser 22 to the swirl plate 60 for passage through the swirl ports 62 therein to rotatably drive the turbine 16. This water flow axially passes the turbine 16 and proceed further upwardly through the jet ports 42 in the pattern plate 38 to impinge upon the array of vanes 24, thereby imparting a rotary drive torque to the deflector 12 as previously described. In addition, the water flow is subdivided by the vanes 24 into the plurality of relatively small water streams 14 for outwardly projection from the sprinkler.

The thus-driven turbine 16 rotatably drives the drive shaft 26 at a relatively high speed, for correspondingly rotating the drive pin 74 with an eccentric or off-axis rotary motion. The drive pin 74 imparts this off-axis or eccentric motion to the orbiter 28, causing the reaction and drive gears 78, 80 thereon to rotate slowly about a central axis of the drive shaft 26. In the course of such orbital motion, the reaction gear 78 reacts against the nonrotational stator gear 30, while the drive gear 80 rotatably drives the driven gear 32 at a slow rotational speed reflective of the total gear train speed reduction, e.g., a speed reduction of 1,024 in the foregoing example. Thus, the rotational speed of the cap plate 88 and the deflector 12 attached thereto is effectively regulated or limited by the turbine driven speed governor of the present invention at a relatively slow rate for slowly sweeping the projected water streams 14 over the surrounding terrain area. Importantly, the turbine 16 and speed reduction gear train 18 are designed to provided a deflector rotational speed in the range of about 4–20 rpm during sprinkler operation at normal water supply pressures and flow rates. Due to the large speed reduction ratio provided by the gear train 18, the rotational speed of the deflector 12 remains approximately constant despite variations in water supply pressure and flow rate with normal operation ranges.

Figure 11:
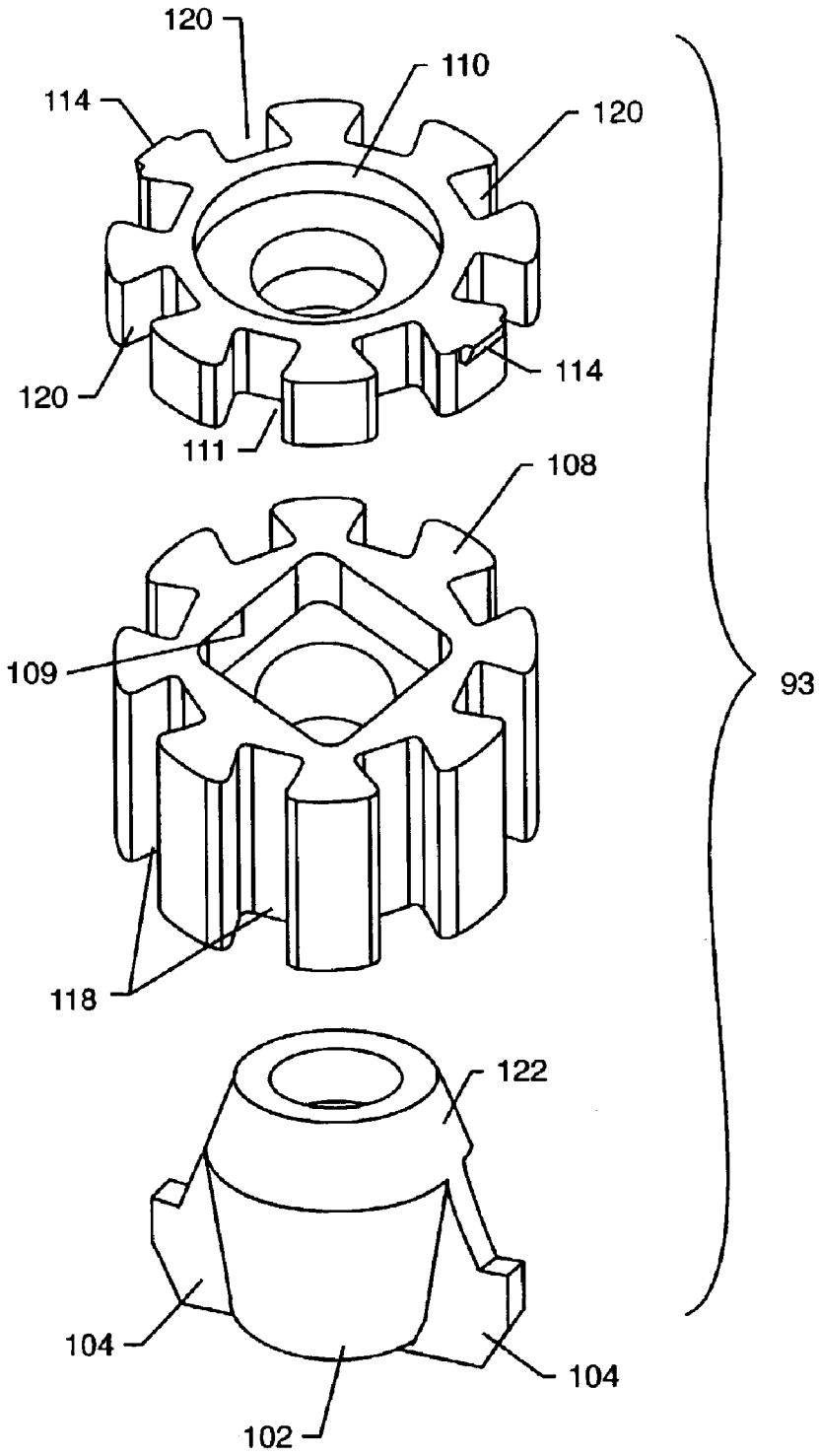
FIG. 11 is an enlarged and exploded perspective view showing components of a flow rate adjustment assembly for the sprinkler.

A flow rate adjustment assembly 93 (FIGS. 3 and 11–12) may be provided for selectively setting the water flow rate through the sprinkler 10, for purposes of regulating the range of throw of the projected water streams 14. As shown (FIG. 3), this flow rate adjustment assembly 93 is mounted within the filter unit 44 at an upstream location relative to the swirl plate 60. Conveniently, the flow rate adjustment assembly 93 is adapted for variable setting by means of a screwdriver 94 (FIG. 12) or other suitable tool tip engageable with a screwdriver slot 95 or the like formed in an upwardly exposed surface of the cap plate 88 (FIGS. 1, 4 and 12).

Figure 3:
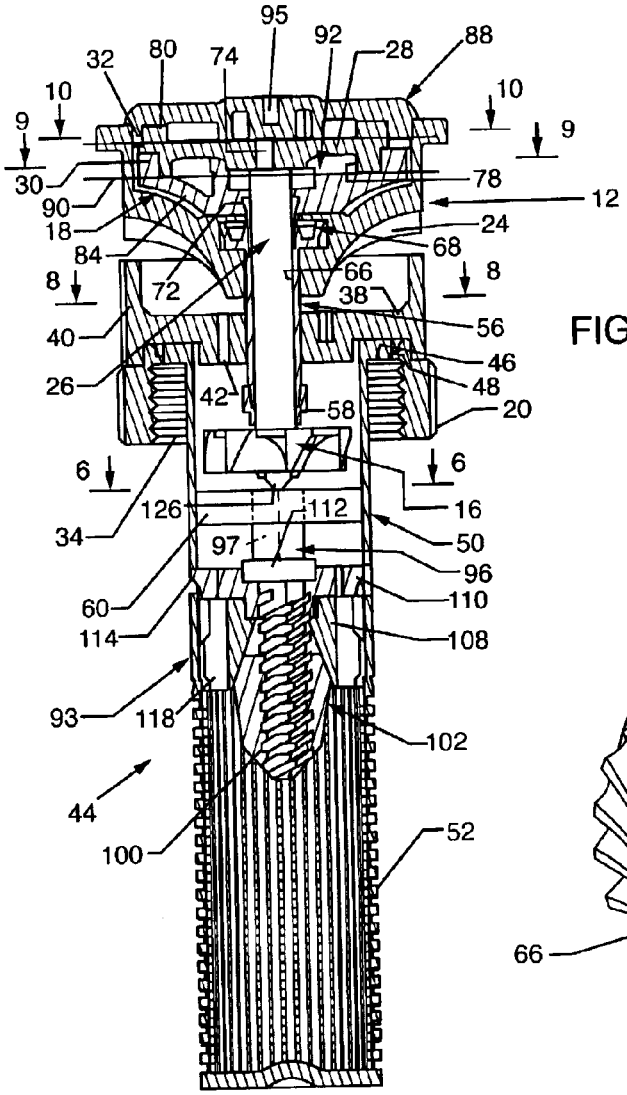
FIG. 3 is an enlarged vertical sectional view taken generally on the line 3—3 of FIG. 1.
Figure 5:
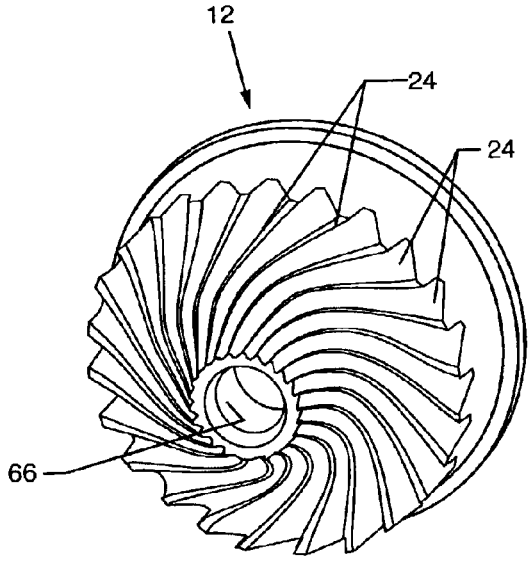
FIG. 5 is an enlarged underside perspective view of the vaned deflector.
Figure 4:
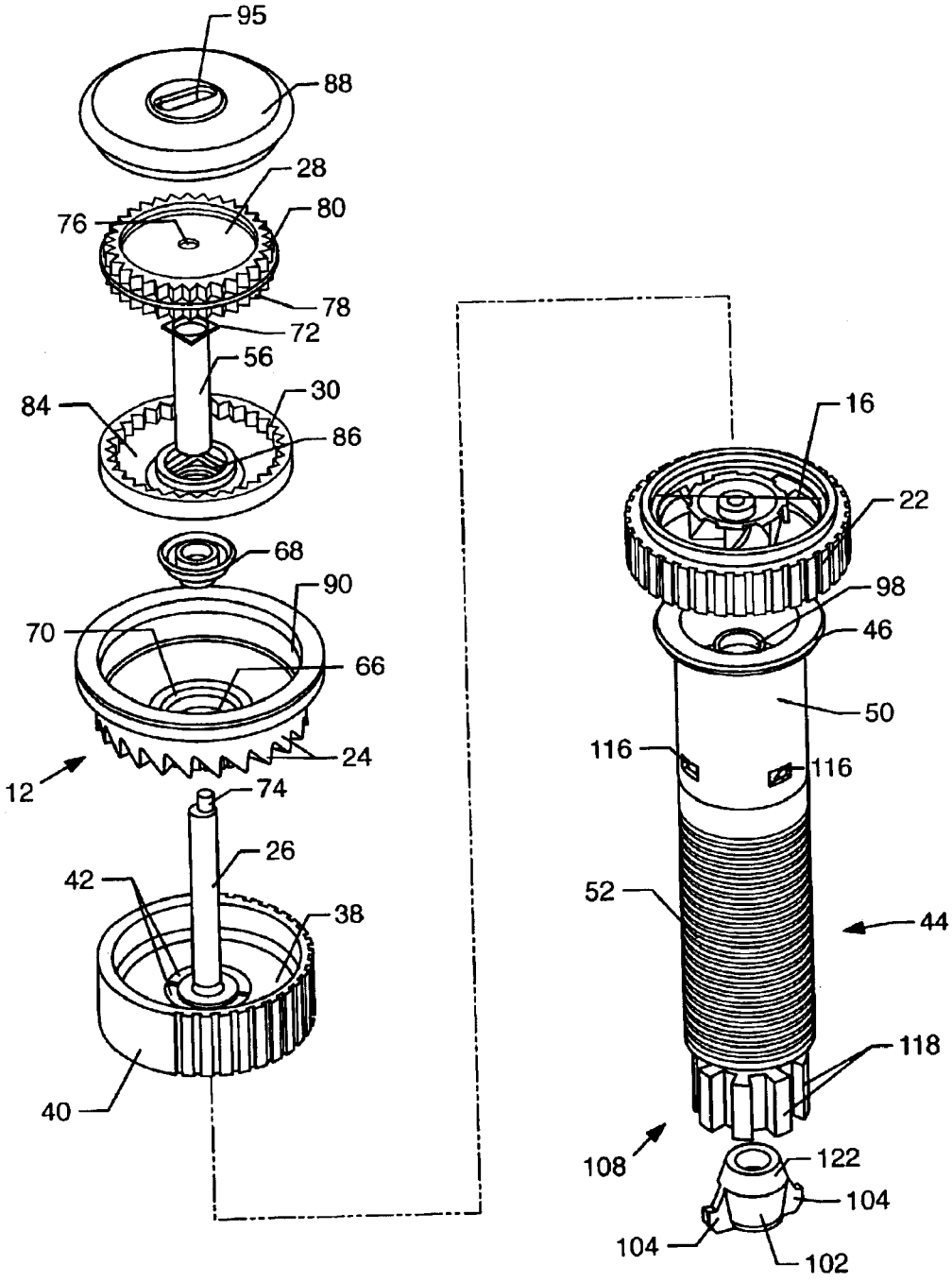
FIG. 4 is an exploded perspective view of the rotating stream sprinkler.
Figure 9:
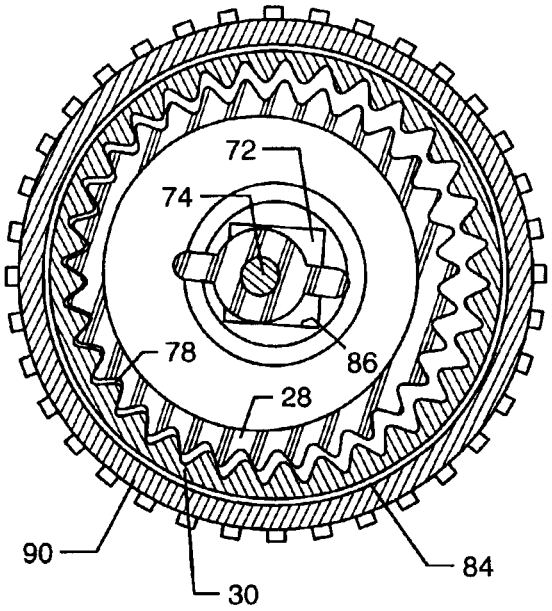
FIG. 9 is a horizontal sectional view taken generally on the line 9—9 of FIG. 3 showing a first or reaction gear on a eccentrically driven orbiter in meshed related with a stator gear.
Figure 10:
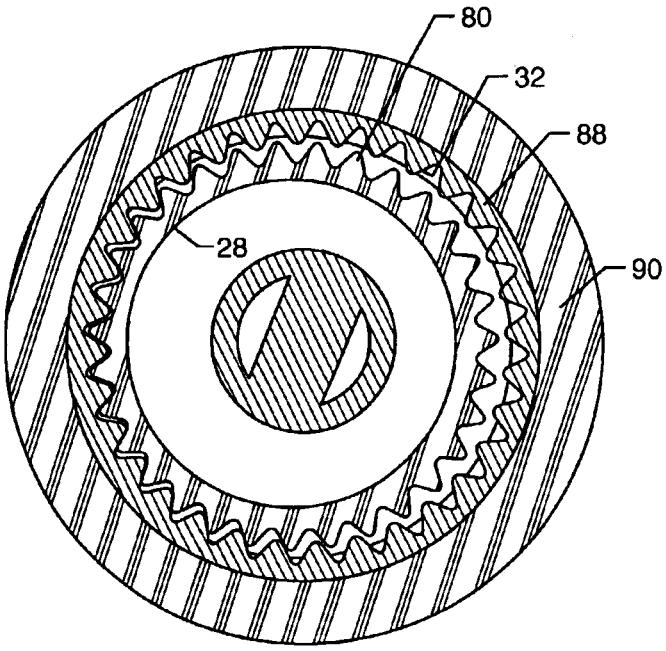
FIG. 10 is a horizontal sectional view taken generally on the line 10—10 of FIG. 3 showing a second or drive gear on the orbiter in meshed relation with a driven gear rotatable with the vaned deflector.

The illustrative flow rate adjustment assembly 93 includes an adjustment screw 96 having a head 97 rotatably carried and axially retained by a cylindrical hub 98 of the swirl plate 60 (FIGS. 3, and 6–7). A threaded screw shank 100 is suspended from the head 97 to project downwardly into the interior of the filter unit 44, in a direction away from the swirl plate 60. A flow rate adjustment nut 102 is threaded carried on the shank 100 and includes at least one and preferably multiple radially outwardly extending wings 104 engages with internal ribs or splines 106 (FIG. 12) formed within the perforated lower side wall segment 52. Accordingly, rotation of the screw head 97 and associate shank 100 is accompanied by axial translation of the flow rate adjustment nut 102 on the screw, without nut rotation.

Figure 12:
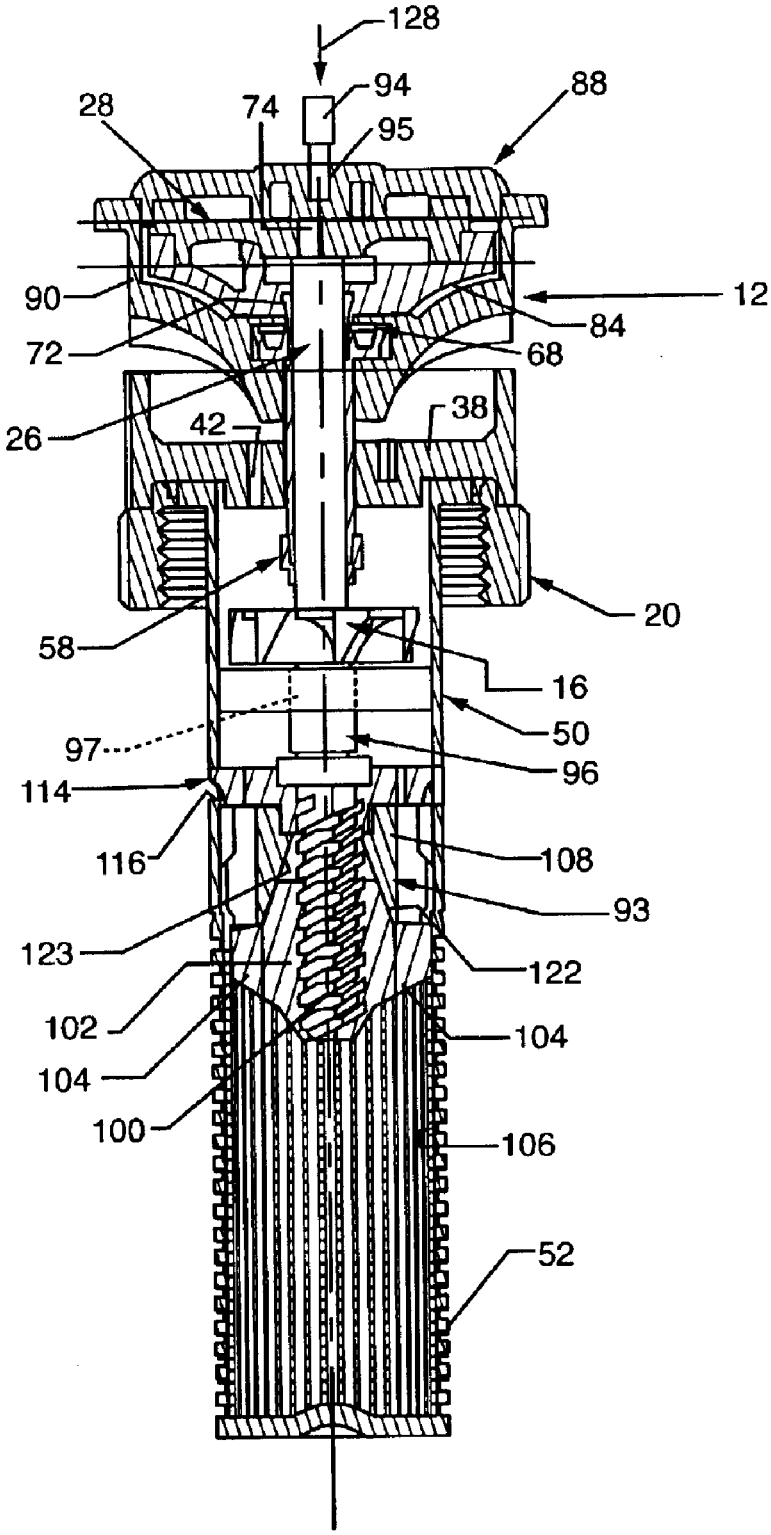
FIG. 12 is an enlarged vertical sectional view similar to FIG. 3, but illustrating adjustment of the flow rate adjustment assembly.

A resilient flow rate restrictor element 108 is captured between the flow rate adjustment nut 102 and a support disk 110 seated axially against a backstop flange 112 formed on the screw head 97 (FIGS. 3 and 12). In addition, this support disk 110 may also include a pair of outwardly radiating ears 114 (shown best in FIGS. 2 and 12) for snap-fit reception into a corresponding pair of side ports 116 formed in the imperforate upper side wall segment 50 of the filter unit 44. As shown, the support disk 110 includes a downwardly protruding nose 111 (FIG. 11) of noncircular geometry for seated reception into a matingly shaped noncircular seat 109 (FIG. 11) formed in an upper side of the restrictor element 108 to rotationally align and retain these components with respect to each other. Importantly, the restrictor element 108 includes a plurality of peripheral flow channels or slots 118 (FIGS. 11–12) which are respectively aligned axially with a corresponding plurality of peripheral flow channels or slots 120 formed in the support disk 110. These aligned flow channels 118, 120 accommodate upward water flow past the flow rate adjustment assembly 93 and further to the swirl plate 60 for normal sprinkler operation.

However, the flow rate of water through these channels 118, 120 can be selectively throttled or reduced by rotating the adjustment screw 96 in a direction translating the adjustment nut 102 in an upward direction to compress the restrictor element 108. Such adjustment is illustrated in FIG. 12 which shows a conically tapered upper surface 122 on the nut 102 bearing against a matingly tapered lower surface 123 on the restrictor element 108, to cause a side wall of the restrictor element 108 to bulge radially outwardly by a selected increment, resulting in restriction of the cross sectional areas of the flow channels 118 and a corresponding restriction or reduction in water flow rate past the adjustment assembly 93.

The head 97 of the adjustment screw 96 includes an upwardly presented slotted recess 125 (FIG. 6) which is normally positioned in axially spaced relation below the turbine 16. However, a lower end of the drive shaft 26 includes a slotted tool tip 126 for axial displacement downwardly into engagement with the adjustment screw head 97, if and when flow rate adjustment is desired or required.

More particularly, to adjust the water flow rate through the sprinkler 10 and thereby select the projected range of the water streams 14, the screwdriver or other suitable tool 94 (FIG. 16) is engaged with the slot 95 in the cap plate 88 with sufficient downward pressure is applied (as indicated by arrow 128 in FIG. 12) to shift the deflector 12 together with the drive shaft 26 and the associated gear train components axially downwardly through a short stroke relative to the bearing sleeve 56 supported by the underlying pattern plate 38. This axially downward displacement of these components is sufficient to disengage the hub recess 86 of the stator member 84 from the stator key 72 on the bearing sleeve 56, and thereby permit rotation of the stator member 84 with the deflector 12 and other components of the gear train 18. This downward displacement also displaces the slotted tool tip 126 on the lower end of the drive shaft 26 into engagement with the slotted recess 125 formed in the head 97 of the adjustment screw 96.

In this downwardly shifted position with the stator member 84 free to rotate, rotatable displacement of the tool 94 is effective to rotate the deflector 12 and the gear train components to correspondingly rotate the drive shaft 26 is either direction. This rotational displacement is transmitted via the drive shaft 26 directly to the adjustment screw 96 for variably setting the adjustment nut 102 compressively against the restrictor element 108, as previously described, to adjust water flow rate to the swirl plate 60 and other operating components of the sprinkler. Importantly, the large speed ratio reduction provided by the gear train 18 effectively locks the cap plate 88 and deflector 12 with the gear train for positive rotary displacement of the drive shaft 26 during this adjustment step. Upon release of the adjustment tool 94 from the cap plate 88, and subsequent supply of water under pressure to the sprinkler 10, the upward force of the water jet or jets applied to the vaned underside of the deflector 12 functions to assure return displacement of the downwardly shifted components back to a normal operating position with the tool tip 126 on the drive shaft 26 spaced above and disengaged from the adjustment screw head 97 (as viewed in FIG. 3).

A variety of further modifications and improvements in and to the rotating stream sprinkler of the present invention will be apparent to those persons skilled in the art. Accordingly, no limitation on the invention is intended by way of the foregoing description and accompanying drawings, except as set forth in the appended claims.

What is claimed is:

1. A rotating stream sprinkler, comprising:

a rotatable deflector having a center axis of rotation and an underside surface defining an array of vanes;

ports for directing at least one water jet into engagement with said vanes, said vanes subdividing and redirecting said at least one water jet into a plurality of relatively small water streams projected generally radially outwardly therefrom; and a water-driven speed reduction gear train having an eccentric drive and a first gear having an eccentric axis of rotation, the eccentric drive coupled to the first gear to cause the eccentric axis of rotation of the first gear to orbit about the center axis of rotation of the deflector for rotating said deflector at a regulated and relatively slow rotational speed for sweeping the projected water streams relatively slowly over a surrounding terrain area.

2. The rotating stream sprinkler of claim 1 wherein the water-driven speed reduction gear train further includes at least a second gear, and the first and the at least second gear have a different number of teeth than the first gear.

3. The rotating stream sprinkler of claim 1 including a water-driven turbine mounted on a drive shaft for providing a rotary input to said speed reduction gear train.

4. The rotating stream sprinkler of claim 3 further including a swirl plate having at least one swirl port formed therein for providing a circumferentially swirling water flow for rotatably driving said turbine.

5. The rotating stream sprinkler of claim 4 wherein said swirl plate and said turbine are mounted upstream relative to said water jet means.

6. A rotating stream sprinkler, comprising:

a rotatable deflector having an underside surface defining an array of vanes;

means for directing at least one water jet into engagement with said vanes, said vanes subdividing and redirecting said at least one water jet into a plurality of relatively small water streams projected generally radially outwardly therefrom;

a water-driven speed reduction gear train for rotating said deflector at a regulated and relatively slow rotational speed for sweeping the projected water streams relatively slowly over a surrounding terrain area; and a water-driven turbine mounted on a drive shaft for providing a rotary input to said speed reduction gear train, wherein said speed reduction gear train comprises an orbiter including a reaction gear and a drive gear, a substantially nonrotational stator member including a stator gear meshed with said reaction gear, a driven gear carried for rotation with said deflector and meshed with said drive gear, and said drive shaft and said orbiter coupled for rotatably driving said orbiter on an eccentric axis relative to a rotational axis of said drive shaft, said reaction gear reacting against said stator gear whereby said drive gear rotatably drives said driven gear and said deflector at said relatively slow rotational speed.

7. The rotating stream sprinkler of claim 6 wherein said drive shaft and said orbiter are coupled for rotatably driving said orbiter on an eccentric axis by an off-axis drive pin carried by said drive shaft.

8. The rotating stream sprinkler of claim 6 wherein said reaction gear is meshed with said stator gear, and said drive gear is meshed with said driven gear along a common radial line of contact.

9. The rotating stream sprinkler of claim 6 wherein said reaction gear and said drive gear comprise coaxial ring gears of substantially common diametric size, and further wherein said stator gear and said driven gear comprise coaxial rings gears of substantially common diametric size larger than the diametric size of said reaction and drive gears.

10. The rotating stream sprinkler of claim 6 wherein said reaction and drive gears have a different number of gear teeth.

11. The rotating stream sprinkler of claim 6 wherein said reaction and stator gears have a different number of gear teeth.

12. The rotating stream sprinkler of claim 11 wherein said drive and driven gears have a different number of gear teeth.

13. The rotating stream sprinkler of claim 12 wherein said reaction and drive gears have a different number of gear teeth.

14. The rotating stream sprinkler of claim 6 wherein said drive and driven gears have a different number of gear teeth.

15. The rotating stream sprinkler of claim 6 further including a substantially nonrotational bearing sleeve rotatably supporting said drive shaft, and having said deflector rotatably supported thereon, said bearing sleeve including a stator key normally engaged with said stator member for locking said stator member against rotation.

16. The rotating stream sprinkler of claim 6 wherein said driven gear is carried by a cap plate mounted on said deflector and rotatable therewith, said cap plate and said deflector cooperatively defining a substantially closed chamber having said speed reduction gear train therein.

17. The rotating stream sprinkler of claim 1 wherein said array of vanes formed on said deflector underside surface comprises an array of spiral vanes, whereby said at least one water jet directed into engagement with said vanes imparts a rotary torque to said deflector.

18. The rotating stream sprinkler of claim 1 wherein said water-driven speed reduction gear train rotatably drives said deflector at a rotational speed on the order of about 4–20 rpm.

19. The rotating stream sprinkler of claim 1 wherein said array of vanes on said deflector underside surface comprises a plurality of vanes having upstream segments extending generally upwardly and then curving smoothly with a spiral component of direction to merge with relatively straight downstream segments extending generally radially outwardly with a selected angle of inclination, said plurality of vanes defining a corresponding plurality of intervening flow channels.

20. The rotating stream sprinkler of claim 1 further including a sprinkler base adapted for mounting onto an upper end of a tubular riser adapted in turn for connection to a supply of water under pressure, said base having said deflector rotatably supported thereon, said means for directing at least one water jet into engagement with said vanes comprising a pattern plate carried by said base and having at least one jet port formed therein.

21. The rotating stream sprinkler of claim 20 wherein said at least one jet port formed in said base is formed in a predetermined configuration to provide a predetermined pattern of water streams projected outwardly from said deflector.

22. The rotating stream sprinkler of claim 1 further including a flow rate adjustment assembly for variably adjusting water flow to the sprinkler.

23. The rotating stream sprinkler of claim 22 wherein said flow rate adjustment assembly comprises a rotatable adjustment screw, an adjustment nut axially translatable on said screw upon rotation thereof, and a resilient restrictor element having at least one flow channel formed therein, said restrictor element being compressible by said nut upon rotation of said screw for varying the cross sectional size of said at least one flow channel thereby variably throttling water flow to the sprinkler.

24. The rotating stream sprinkler of claim 22 further including a generally cup-shaped filter unit having said flow adjustment assembly mounted therein.

25. The rotating stream sprinkler of claim 22 further including means for engaging and rotating said adjustment screw from the exterior of the sprinkler.

26. A rotating stream sprinkler, comprising;

a rotatable sprinkler head having at least one portion configured for projecting water from the sprinkler generally radially outwardly therefrom and swept thereby over a surrounding terrain area; and a speed control governor including a water-driven speed reduction gear train for limiting rotation of said sprinkler head to a regulated and relatively slow rotational speed for sweeping the projected water streams relatively slowly over the surrounding terrain area and at an approximately constant rotational speed throughout a normal operating range of water pressures and flow rates, the speed reduction gear train including:

a drive shaft, a water-driven turbine mounted on said drive shaft for providing a rotary input to said speed reduction gear train, a nonrotational stator member, a reaction gear mounted on and driven by said drive shaft, the reaction gear cooperating with the stator member, and a drive gear mounted on and driven by said drive shaft, the drive gear rotating at the same rate as the reaction gear and cooperating with and rotating said sprinkler head at said regulated and relatively slow rotational speed.

27. The rotating stream sprinkler of claim 26 wherein said speed control governor further includes a water-driven turbine mounted on a drive shaft for providing a rotary input to said speed reduction gear train.

28. The rotating stream sprinkler of claim 27 further including a swirl plate having at least one swirl port formed therein for providing a circumferentially swirling water flow for rotatably driving said turbine.

29. The rotating stream sprinkler of claim 28 wherein said swirl plate and said turbine are mounted upstream relative to said portion configured for projecting water.

30. A rotating stream sprinkler, comprising:

a rotatable deflector having an underside surface defining an array of spiral vanes;

ports for directing at least one water jet into engagement with said spiral vanes to impart a rotary drive torque to said deflector for rotatably driving said deflector, said vanes subdividing and redirecting said at least one water jet into a plurality of relatively small water streams projected generally radially outwardly therefrom and swept thereby over a surrounding terrain area; and a speed control governor including a water-driven speed reduction gear train for limiting rotation of said deflector to a regulated and relatively slow rotational speed for sweeping the projected water streams relatively slowly over the surrounding terrain area and at an approximately constant rotational speed throughout a normal operating range of water pressures and flow rates, said speed control governor further including a water-driven turbine mounted on a drive shaft for providing a rotary input to said speed reduction gear train, wherein said speed reduction gear train comprises an orbiter including a reaction gear and a drive gear, a substantially nonrotational stator member including a stator gear meshed with said reaction gear, a driven gear carried for rotation with said deflector and meshed with said drive gear, and said drive shaft and said orbiter coupled for rotatably driving said orbiter on an eccentric axis relative to a rotational axis of said drive shaft, said reaction gear reacting against said stator gear whereby said drive gear rotatably drives said driven gear and said deflector at said relatively slow rotational speed.

31. The rotating stream sprinkler of claim 30 wherein said drive shaft and said orbiter are coupled for rotatably driving said orbiter on an eccentric axis by an off-axis drive pin carried by said drive shaft.

32. The rotating stream sprinkler of claim 30 wherein said reaction gear is meshed with said stator gear, and said drive gear is meshed with said driven gear along a common radial line of contact.

33. The rotating stream sprinkler of claim 30 wherein said reaction gear and said drive gear comprise coaxial ring gears of substantially common diametric size, and further wherein said stator gear and said driven gear comprise coaxial rings gears of substantially common diametric size larger than the diametric size of said reaction and drive gears.

34. The rotating stream sprinkler of claim 30 wherein at least one of said reaction and drive gears, said reaction and stator gears, and said drive and drive gears, comprises a pair of gears having a different number of gear teeth.

35. The rotating stream sprinkler of claim 30 further including a substantially nonrotational bearing sleeve rotatably supporting said drive shaft, and having said deflector rotatably supported thereon, said bearing sleeve including a stator key normally engaged with said stator member for locking said stator member against rotation.

36. The rotating stream sprinkler of claim 35 wherein said driven gear is carried by a cap plate mounted on said deflector and rotatable therewith, said cap plate and said deflector cooperatively defining a substantially closed chamber having said speed reduction gear train therein.

37. The rotating stream sprinkler of claim 35 further including a flow rate adjustment assembly for variably adjusting water flow to the sprinkler, said flow rate adjustment assembly comprising a rotatable adjustment screw, an adjustment nut axially translatable on said screw upon rotation thereof, and a resilient restrictor element having at least one flow channel formed therein, said restrictor element being compressible by said nut upon rotation of said screw for varying the cross sectional size of said at least one flow channel thereby variably throttling water flow to the sprinkler.

38. The rotating stream sprinkler of claim 35 further including a generally cup-shaped filter unit having said flow adjustment assembly mounted therein.

39. The rotating stream sprinkler of claim 35 further including means for engaging and rotating said adjustment screw from the exterior of the sprinkler.

40. The rotating stream sprinkler of claim 39 wherein said means for engaging and rotating said adjustment screw comprises a tool slot formed in said cap plate, and a tool tip formed on a lower end of said drive shaft, said cap plate tool slot being tool-engageable to axially depress said cap plate and said deflector relative to said bearing sleeve for disengaging said stator key from said stator member and to engage said tool tip with said adjustment screw, said cap plate and said deflector being thereupon rotatable for rotatably adjusting said adjustment screw to variably select said flow rate.

41. A rotating stream sprinkler, comprising:

a base adapted for mounting onto a tubular riser for connection to a supply of water under pressure;

a deflector having an underside surface defining an array of spiral vanes;, said deflector being mounted above and rotatable relative to said base;

a pattern plate carried by said base and having at least one jet port formed therein for directing at least one water jet generally upwardly into engagement with said spiral vanes to impart a rotary drive torque to said deflector for rotatably driving said deflector, said vanes subdividing and redirecting said at least one water jet into a plurality of relatively small water streams projected generally radially outwardly therefrom and swept thereby over a surrounding terrain area; and a speed control governor including a water-driven turbine mounted on a drive shaft, and speed reduction gear train coupled between said drive shaft and said deflector for limiting rotation of said deflector to a regulated and relatively slow rotational speed for sweeping the projected water streams relatively slowly over the surrounding terrain area and at an approximately constant rotational speed throughout a normal operating range of water pressures and flow rates;

said speed reduction gear train comprising an orbiter including a reaction gear and a drive gear, a substantially nonrotational stator member including a stator gear meshed with said reaction gear, a driven gear carried for rotation with said deflector and meshed with said drive gear, and drive means coupled between said drive shaft and said orbiter for rotatably driving said orbiter on an eccentric axis relative to a rotational axis of said drive shaft, said reaction gear reacting against said stator gear whereby said drive gear rotatably drives said driven gear and said deflector at said relatively slow rotational speed.

42. The rotating stream sprinkler of claim 41 further including a swirl plate having at least one swirl port formed therein for providing a circumferentially swirling water flow for rotatably driving said turbine.

43. The rotating stream sprinkler of claim 42 wherein said swirl plate and said turbine are mounted upstream relative to said water jet means.

44. The rotating stream sprinkler of claim 41 wherein said drive means for rotatably driving said orbiter on an eccentric axis comprises an off-axis drive pin carried by said drive shaft.

45. The rotating stream sprinkler of claim 41 wherein said reaction gear is meshed with said stator gear, and said drive gear is meshed with said driven gear along a common radial line of contact.

46. The rotating stream sprinkler of claim 41 wherein said reaction gear and said drive gear comprise coaxial ring gears of substantially common diametric size, and further wherein said stator gear and said driven gear comprise coaxial rings gears of substantially common diametric size larger than the diametric size of said reaction and drive gears.

47. The rotating stream sprinkler of claim 41 wherein at least one of said reaction and drive gears, said reaction and stator gears, and said driven and drive gears, comprises a pair of gears having a different number of gear teeth.

48. The rotating stream sprinkler of claim 41 further including a substantially nonrotational bearing sleeve rotatably supporting said drive shaft, and having said deflector rotatably supported thereon, said bearing sleeve including a stator key normally engaged with said stator member for locking said stator member against rotation.

49. The rotating stream sprinkler of claim 48 wherein said driven gear is carried by a cap plate mounted on said deflector and rotatable therewith, said cap plate and said deflector cooperatively defining a substantially closed chamber having said speed reduction gear train therein.

50. The rotating stream sprinkler of claim 49 further including a flow rate adjustment assembly for variably adjusting water flow to the sprinkler, said flow rate adjustment assembly comprising a rotatable adjustment screw, an adjustment nut axially translatable on said screw upon rotation thereof, and a resilient restrictor element having at least one flow channel formed therein, said restrictor element being compressible by said nut upon rotation of said screw for varying the cross sectional size of said at least one flow channel thereby variably throttling water flow to the sprinkler.

51. The rotating stream sprinkler of claim 50 further including means for engaging and rotating said adjustment screw from the exterior of the sprinkler.

52. The rotating stream sprinkler of claim 51 wherein said means for engaging and rotating said adjustment screw comprises a tool slot formed in said cap plate, and a tool tip formed on a lower end of said drive shaft, said cap plate tool slot being tool-engageable to axially depress said cap plate and said deflector relative to said bearing sleeve for disengaging said stator key from said stator member and to engage said tool tip with said adjustment screw, said cap plate and said deflector being thereupon rotatable for rotatably adjusting said adjustment screw to variably adjust said flow rate.

* * * * *